US010940703B2

(12) United States Patent
Ichikawa et al.

(10) Patent No.: US 10,940,703 B2
(45) Date of Patent: Mar. 9, 2021

(54) LIQUID JETTING APPARATUS

(71) Applicant: BROTHER KOGYO KABUSHIKI KAISHA, Nagoya (JP)

(72) Inventors: Shohei Ichikawa, Kasugai (JP); Masao Mimoto, Nagoya (JP); Yoshimitsu Taniguchi, Tajimi (JP); Tsuyoshi Ito, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/407,765

(22) Filed: May 9, 2019

(65) Prior Publication Data

US 2019/0351687 A1 Nov. 21, 2019

(30) Foreign Application Priority Data

May 17, 2018 (JP) ..... JP2018-095128

(51) Int. Cl.
*B41J 13/00* (2006.01)
*B41J 13/10* (2006.01)

(52) U.S. Cl.
CPC ..... *B41J 13/0009* (2013.01); *B41J 13/10* (2013.01)

(58) Field of Classification Search
CPC .... B41J 29/38; B41J 13/0009; B41J 13/0036; B41J 13/0045; B41J 13/10; B41J 15/04; B41J 2/2132
See application file for complete search history.

(56) References Cited

U.S. PATENT DOCUMENTS

2004/0212649 A1 10/2004 Ouchi
2005/0275672 A1 12/2005 Koshikawa
2016/0288546 A1* 10/2016 Mizutani ..... B41J 3/60

FOREIGN PATENT DOCUMENTS

JP 2004-237506 A 8/2004
JP 2005-349710 A 12/2005
JP 2007-199534 A 8/2007

* cited by examiner

*Primary Examiner* — Jannelle M Lebron

(74) *Attorney, Agent, or Firm* — Scully, Scott, Murphy & Presser, P.C.

(57) ABSTRACT

A liquid jetting apparatus includes: a conveyance roller; a head; a discharge roller; a tray; a memory; and a controller that receives printing data, drives the conveyance roller and the discharge roller to convey a sheet at a first velocity in a conveyance direction, and controls the head to jet liquid on the sheet. The controller obtains a first amount and a second amount based on the printing data. After the liquid is jetted from the head on the first area, the conveyance roller and the discharge roller are driven to convey the sheet at a second velocity slower than the first velocity and to discharge the sheet on the tray, or conveyance of the sheet is stopped for a predefined time and then the sheet is conveyed at the first velocity to be discharged on the tray.

11 Claims, 9 Drawing Sheets

LIQUID JETTING APPARATUS

CROSS REFERENCE TO RELATED APPLICATION

The present application claims priority from Japanese Patent Application No. 2018-095128 filed on May 17, 2018, the disclosure of which is incorporated herein by reference in its entirety.

BACKGROUND

Field of the Invention

The present invention relates to a liquid jetting apparatus configured to jet liquid on a sheet.

Description of the Related Art

There is known, as an exemplary liquid jetting apparatus configured to jet liquid on a sheet, an ink-jet recording apparatus configured to perform printing on a sheet by jetting ink droplets from nozzles provided in a head.

A sheet used in the ink-jet recording apparatus may curve due to permeation of ink droplets into the sheet. When a front end of the sheet (a downstream end in a conveyance direction of the sheet) curves, the curved front end may be caught by a tray of the apparatus during discharge of the sheet from the apparatus. This may cause failure in the sheet discharge.

In order to solve the above problem, after ink droplets are jetted on the front end of the sheet, the ink droplets are dried by stopping conveyance of the sheet or reducing conveyance velocity of the sheet.

SUMMARY

However, when the conveyance of the sheet is frequently stopped or when the conveyance velocity of the sheet is frequently reduced, a time after a printing command to perform printing on the sheet is received before the sheet for which printing has been performed is discharged lengthens.

The present teaching is made in view of the above problem, and an object of the present teaching is to provide a liquid jetting apparatus that is capable of discharging a sheet as early as possible while the sheet is discharged properly.

According to an aspect of the present teaching, there is provided a liquid jetting apparatus, including: a conveyance roller; a head positioned downstream of the conveyance roller in a conveyance direction; a discharge roller positioned downstream of the head in the conveyance direction; a tray positioned downstream of the discharge roller in the conveyance direction and configured to support a sheet on which an image has been recorded using the head; a memory; and a controller configured to: receive printing data, drive the conveyance roller and the discharge roller to convey a sheet at a first velocity in the conveyance direction, and control the head to jet liquid on a printing surface of the sheet conveyed by the conveyance roller and the discharge roller, wherein the controller is configured to: obtain a first amount and a second amount based on the printing data, the first amount being a jetting amount per unit area of the liquid jetted from the head on a first area that is included in the printing surface and includes a downstream end of the printing surface in the conveyance direction, the second amount being a jetting amount per unit area of the liquid jetted from the head on a second area that is included in the printing surface and positioned upstream of the first area in the conveyance direction; and in a case that the first amount is equal to or more than a first threshold value stored in the memory and the second amount is equal to or more than a second threshold value stored in the memory, after jetting the liquid from the head on the first area, drive the conveyance roller and the discharge roller to execute conveyance of the sheet at a second velocity slower than the first velocity and to discharge the sheet on the tray, or stop the conveyance roller and the discharge roller to stop the conveyance of the sheet for a predefined time, and then drive the conveyance roller and the discharge roller to execute the conveyance of the sheet at the first velocity and to discharge the sheet on the tray.

When the amount of liquid jetted on the first area is large, the first area of the sheet swells to make the sheet easily curve. When the amount of liquid jetted on the second area is large in the state where the sheet is likely to curve, the rigidity of the second area of the sheet decreases. This curves the first area of the sheet already having the easy-to-curve state. When the amount of liquid jetted on the second area is small in the state where the sheet is likely to curve, the decrease in rigidity of the second area of the sheet is inhibited. This inhibits the curve of the first area of the sheet. Namely, even when the amount of liquid jetted on the first area is large, it is possible to inhibit the curve of the first area of the sheet when the amount of liquid jetted on the second area is small.

In the above configuration, when the first amount is equal to or more than the first threshold value and the second amount is equal to or more than the second threshold value, the controller stops the conveyance of the sheet for the predefined time or decreases the conveyance velocity. When the first amount is equal to or more than the first threshold value and the second amount is less than the second threshold value, the controller neither executes the standstill or stop of conveyance of the sheet nor the decrease in conveyance velocity. This can reduce the frequency of the standstill of sheet conveyance or the frequency of the decrease in conveyance velocity.

According to the present teaching, the sheet can be discharged as early as possible while the sheet is discharged properly.

DESCRIPTION OF THE EMBODIMENTS

Figure 1:
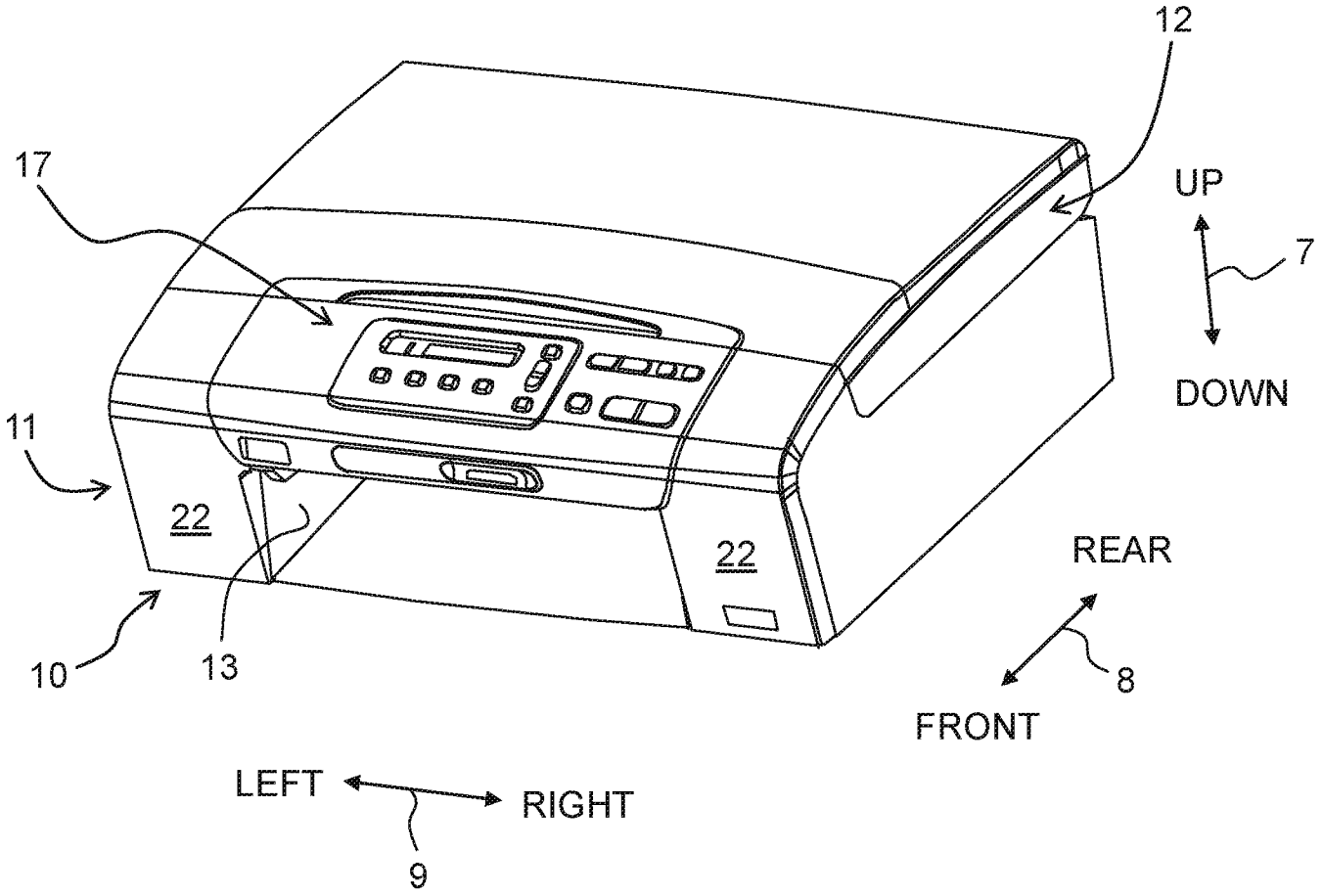
FIG. 1 is a perspective view of an external appearance of a multifunction peripheral.

An embodiment of the present teaching is described below. The embodiment described below is merely an example of the present teaching and it is possible to make any appropriate change(s) in the embodiment of the present teaching without departing from the gist and/or scope of the present teaching. In the following explanation, an up-down direction 7 is defined based on a state where a multifunction peripheral 10 is disposed to be usable (the state depicted in FIG. 1). A front-rear direction 8 is defined as a surface provided with an opening 13 is a front surface 22 of the multifunction peripheral 10. A left-right direction 9 is defined as the multifunction peripheral 10 is seen from the front side. The up-down direction 7, the front-rear direction 8, and the left-right direction 9 are orthogonal to each other.

<Structure of Multifunction Peripheral 10>

As depicted in FIG. 1, the multifunction peripheral 10 (an exemplary liquid jetting apparatus) has a substantially rectangular parallelepiped shape. A scanner unit 12 is provided in an upper portion of the multifunction peripheral 10. The scanner unit 12 reads an image recorded on a document, such as a sheet, by use of an image sensor to obtain printing data. A printer unit 11 is provided in a lower portion of the multifunction peripheral 10. The printer unit 11 records an image on a sheet 15 (an exemplary sheet, see FIG. 2), namely, performs printing of an image on the sheet 15, based on printing data from the scanner unit 12 or printing data from an external apparatus, such as a personal computer, connected to the multifunctional peripheral 10 via a local area network (LAN).

In this embodiment, the printing data includes data that corresponds to an image to be formed on the sheet 15 through printing and a command (e.g., a printing command for starting printing) for controlling printing of the data on the sheet 15. When the wording "printing data" is simply referred to in the following description, the printing data means data that corresponds to an image to be formed on the sheet 15 through printing.

A feed tray 20 (see FIG. 2) capable of supporting the sheet 15 is installed in the opening 13 formed in the front surface of the printer unit 11. The feed tray 20 is inserted into or removed from the printer unit 11 by sliding in the front-rear direction 8. A discharge tray 21 (an exemplary tray) is placed on an upper front portion of the feed tray 20. The sheet 15 printed by the recording unit 24 and discharged from the multifunction peripheral 10 is supported by an upper surface of the discharge tray 21.

Figure 2:
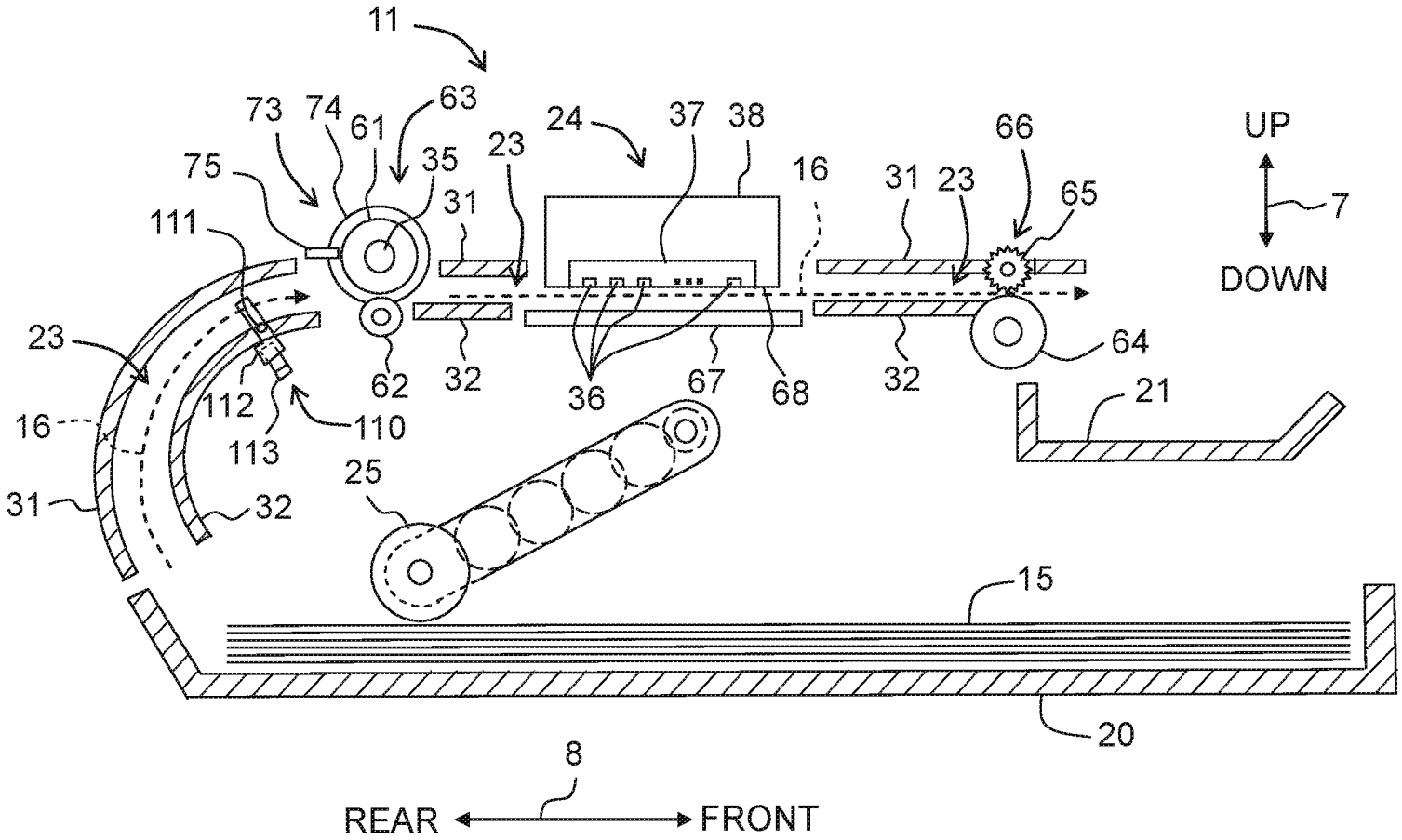
FIG. 2 is a vertical cross-sectional view schematically depicting an internal structure of a printer unit.

As depicted in FIG. 2, the printer unit 11 includes a conveyance path 23, a feed roller 25, a conveyance roller pair 63, and a discharge roller pair 66, and a recording unit 24.

The conveyance path 23 is a path through which the sheet 15 passes. Rotating the feed roller 25 by a feed motor 102 (see FIG. 3) feeds the sheet 15 supported by the feed tray 20 to the conveyance path 23. The conveyance path 23 is provided with the conveyance roller pair 63 and the discharge roller pair 66. The conveyance roller pair 63 and the discharge roller pair 66 convey the sheet 15, which is fed to the conveyance path 23 by use of the feed roller 25. The recording unit 24 records an image on the sheet 15 in accordance with an ink-jet system based on printing data. The feed roller 25 may be rotated by a conveyance motor 101 described below.

<Conveyance Path 23>

As depicted in FIG. 2, the conveyance path 23 makes a U-turn while extending upward from a rear end of the feed tray 20, extends frontward while passing below the recording unit 24, and reaches the discharge tray 21. The conveyance path 23 is a space defined by a first guide member 31 and a second guide member 32 that face each other with a predefined interval intervening therebetween. The sheet 15 is conveyed through the conveyance path 23 in a conveyance direction 16 depicted by broken line arrows in FIG. 2.

<Conveyance Roller Pair 63 and Discharge Roller Pair 66>

As depicted in FIG. 2, the conveyance path 23 is provided with the conveyance roller pair 63, which includes a conveyance roller 61 and a pinch roller 62. The pinch roller 62 is urged toward and brought in contact with a roller surface of the conveyance roller 61 by use of an elastic member (not shown), such as a spring. The conveyance path 23 is provided with the discharge roller pair 66 at a downstream side in the conveyance direction 16 from the conveyance roller pair 63. The discharge roller pair 66 includes a discharge roller 64 and a spur 65. The discharge roller pair 66 is positioned at an upstream side in the conveyance direction 16 from the discharge tray 21. The spur 65 is urged toward and brought in contact with a roller surface of the discharge roller 64 by use of an elastic member (not shown), such as a spring.

When receiving driving force from the conveyance motor 101 (see FIG. 3), the conveyance roller 61 and the discharge roller 64 rotate. The conveyance roller 61 and the discharge roller 64 receiving the driving force convey the sheet 15 in the conveyance direction 16 while nipping the sheet 15 between the conveyance roller 61 and the pinch roller 62 and between the discharge roller 64 and the spur 65.

<Recording Unit 24>

As depicted in FIG. 2, the recording unit 24 is disposed between the conveyance roller pair 63 and the discharge roller pair 66 in the conveyance path 23. The recording unit 24 includes a head 37 of an ink-jet system and a carriage 38 carrying the head 37. The carriage 38 is supported by a frame (not depicted) of the printer unit 11 so that the carriage 38 is capable of reciprocating in the left-right direction 9 (an exemplary width direction). The carriage 38 is coupled to a carriage driving motor 103 (see FIG. 3) via a publicly known belt mechanism. When receiving driving force from the carriage driving motor 103, the carriage 38 reciprocates in the left-right direction 9.

Figure 3:
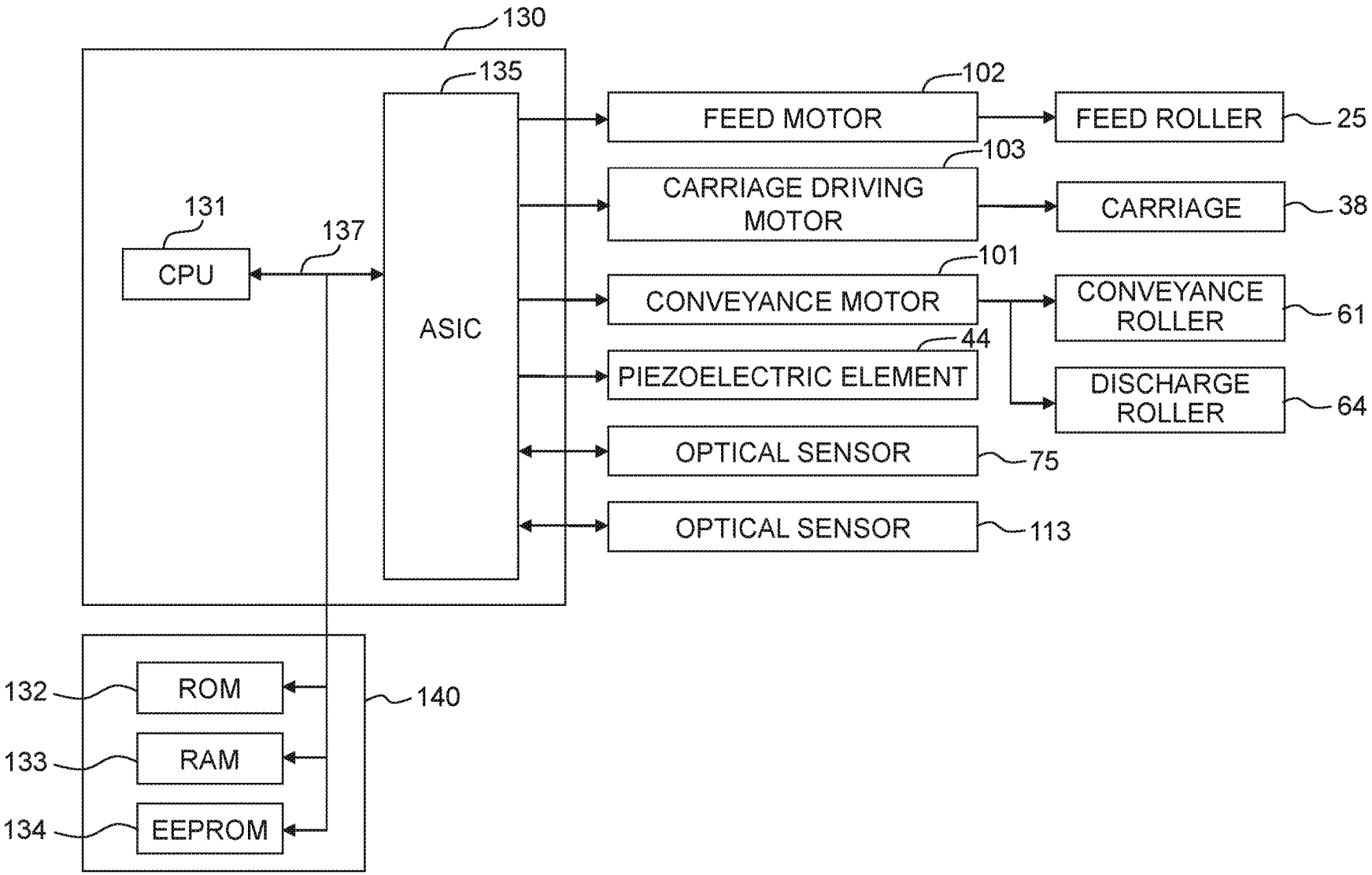
FIG. 3 is a block diagram depicting a configuration of a controller.

The head 37 includes multiple sub tanks (not depicted), multiple nozzles 36, multiple ink channels (not depicted), and multiple piezoelectric elements 44 (see FIG. 3).

An ink (an exemplary liquid) is supplied from an ink cartridge (not depicted), an ink tank (not depicted), or the like to the sub tank. The nozzles 36 are open in a lower surface 68 of the head 37. The ink channels connect the subtank to the nozzles 36. Each piezoelectric element 44 (see FIG. 3) deforms part of the ink channel to jet ink droplets from each nozzle 36. The piezoelectric elements 44 operate when receiving power from a controller 130 (see FIG. 3).

The number of sub tanks corresponds to the number of kinds of inks (e.g., black ink, cyan ink, magenta ink, and yellow ink). The nozzles 36, the ink channels, and the piezoelectric elements 44 are provided corresponding to each sub tank. In the following, explanation is made on the assumption that the head 37 includes one subtank (not depicted), multiple nozzles 36, multiple ink channels (not depicted), and multiple piezoelectric elements 44 (see FIG. 3).

The controller 130 (see FIG. 3) controls the recording unit 24. Specifically, the controller 130 controls the carriage 38 to reciprocate in the left-right direction 9 and controls the head 37 to jet ink droplets from the nozzles 36 toward a platen 67. The platen 67, which is disposed below the head 37 to face the head 37, supports the sheet 15. An image is recorded on a printing surface of the sheet 15 supported by the platen 67 through jetting of ink droplets toward the platen 67. Namely, printing on the sheet 15 is performed. The printing surface of the sheet 15 is a surface that faces the nozzles 36 of the head 37 in a state where the sheet 15 is supported by the platen 67. In other words, the printing surface of the sheet 15 is an upper surface of the sheet 15 with the sheet 15 supported by the platen 67.

<Sensor 110>

As depicted in FIG. 2, the conveyance path 23 includes a sensor 110 at an upstream side in the conveyance direction from the conveyance roller pair 63. The sensor 110 includes a shaft 111, a detecting element 112 that is capable of rotating around the shaft 111, and an optical sensor 113 having a light emitting element and a light receiving element that receives light emitted from the light emitting element.

A first end of the detecting element 112 is in the conveyance path 23. In a state where no external force is applied to the first end of the detecting element 112, a second end of the detecting element 112 is in an optical path ranging from the light emitting element to the light receiving element of the optical sensor 113, thus blocking light passing through the optical path. In that case, the optical sensor 113 outputs a low level signal to the controller 130 (see FIG. 3). When a front end (leading end) of the sheet 15 pushes the first end of the detecting element 112 to make the detecting element 112 rotate, the second end of the detecting element 112 deviates from the optical path to allow light to pass the optical path. In that case, the optical sensor 113 outputs a high level signal to the controller 130. The controller 130 detects the front and rear ends in the conveyance direction 16 of the sheet 15 based on the signals from the optical sensor 113.

<Rotary Encoder 73>

As depicted in FIG. 2, the conveyance roller 61 is provided with a rotary encoder 73 that detects a rotation amount of the conveyance roller 61. The rotary encoder 73 is. The rotary encoder 73 includes an encoder disk 74 which is provided on a shaft 35 of the conveyance roller 61 and rotates together with the conveyance roller 61 and an optical sensor 75. The encoder disk 74 has a pattern in which transmissive portions through which light is transmitted and non-transmissive portions where no light is transmitted are alternately arranged in a circumferential direction at regular pitches. Rotating the encoder disk 74 generates a pulse signal every time the optical sensor 75 detects the transmissive portion or the non-transmissive portion. The pulse signal generated is output to the controller 130 (see FIG. 3). The controller 130 calculates the rotation amount of the conveyance roller 61 based on the pulse signal.

<Controller 130 and Memory 140>

Referring to FIG. 3, configurations of the controller 130 and a memory 140 are explained below. The present teaching is achieved by causing the controller 130 to execute processing in accordance with a flowchart described below. The controller 130 controls operations of the multifunction peripheral 10. The controller 130 includes a CPU 131 and an ASIC 135. The memory 140 includes a ROM 132, a RAM 133, and an EEPROM 134. The CPU 131, ASIC 135, ROM 132, RAM 133, and EEPROM 134 are connected to each other via an internal bus 137.

The ROM 132 stores programs and the like by which the CPU 131 controls a variety of operations. The RAM 133 is used as a storage area in which data, signals, and the like, used by the CPU 131 executing the above programs are stored temporarily, or a working area for data processing. The EEPROM 134 stores settings, flags, and the like that are required to be held or kept after the multifunction peripheral 10 is turned off.

The ASIC 135 is connected to the conveyance motor 101, the feed motor 102, and the carriage drive motor 103. Drive circuits for controlling the respective motors are incorporated in the ASIC 135. The CPU 131 outputs drive signals for rotating the respective motors to the drive circuits corresponding to the respective motors. This rotates the respective motors corresponding to the drive circuits. Namely, the controller 130 controls the feed motor 102 so that the feed roller 25 feeds the sheet 15. Further, the controller 130 controls the conveyance motor 101 so that the conveyance roller pair 63 and the discharge roller pair 66 convey the sheet 15 in the conveyance direction 16. The controller 130 controls the carriage drive motor 103 to move the carriage 40.

The pulse signal output from the optical sensor 75 is input to the ASIC 135. The controller 130 calculates the rotation amount of the conveyance roller 61 based on the pulse signal from the optical sensor 75. The controller 130 calculates the conveyance amount of the sheet 15 from the rotation amount of the conveyance roller 61. The optical sensor 113 is connected to the ASIC 135. The controller 130 detects the front and rear ends in the conveyance direction 16 of the sheet 15, which is at a position where the sensor 110 is disposed, based on the signal(s) from the optical sensor 113.

The ASIC 135 is connected to multiple piezoelectric elements 44. Each piezoelectric element 44 operates when receiving power from the controller 130 via drive circuits (not depicted). The controller 130 controls the power feeding to the piezoelectric elements 44 so that ink droplets are jetted from the nozzles 36 selectively.

The controller 130 determines an ink amount to be jetted from the nozzles 36 based on printing data. For example, the controller 130 adjusts the size of ink droplets to be jetted from each nozzle 36 by adjusting the power feeding to each piezoelectric element 44 depending on the printing data. The controller 130 determines, depending on the printing data, a jetting count of ink droplets for each dot on the printing surface of the sheet 15 (the jetting count of ink droplets is larger as the concentration of each dot is higher). The ink amount for each dot is calculated by multiplying the size of ink droplets by the jetting count of ink droplets. The controller 130 adds up the ink amounts for the dots included in a predefined area of the printing surface of the sheet 15, thus calculating a total ink amount in the predefined area. The controller 130 divides the total ink amount in the predefined area by a planar dimension of the predefined area, thus calculating an ink amount per unit area in the predefined area.

In a case of performing printing on the sheet 15, the controller 130 controls the conveyance motor 101 to execute intermittent conveyance processing in which the conveyance roller pair 63 and the discharge roller pair 66 alternately repeat conveyance of the sheet 15 by a predefined conveyance amount and a standstill or stop of conveyance. The controller 130 executes print processing in a state where conveyance of the sheet 12 is stopped in the intermittent conveyance processing. In the print processing, power feeding to the piezoelectric elements 44 is controlled to jet ink droplets from the nozzles 39 during movement in the left-right direction 9 of the carriage 40. Printing is performed in a partial area of the printing surface of the sheet 15 facing the nozzles 36 through movement of the carriage 40 in one print processing (hereinafter referred to as one pass). Printing can be performed in the entire area of the printing surface of the sheet 15 in which printing can be performed by alternately repeating the intermittent conveyance processing and the print processing.

The controller 130 is not limited to the above configuration. In the controller 130, only the CPU 131 may execute various kinds of processing, only the ASIC 135 may execute various kinds of processing, or the CPU 131 may cooperate with the ASIC 135 to execute various kinds of processing. In the controller 130, the CPU 131 may execute one processing alone, or multiple CPUs 131 may execute one processing in a shared fashion. Or, the ASIC 135 may execute one processing alone, or multiple ASICs 135 may execute one processing in a shared fashion.

<Threshold Value>

The EEPROM 134 stores four threshold values (first threshold value TH1, second threshold value TH2, third threshold value TH3 and fourth threshold value TH4). The four threshold values may not be stored in the EEPROM 134, for example, they may be stored in the ROM 132.

Figure 4:
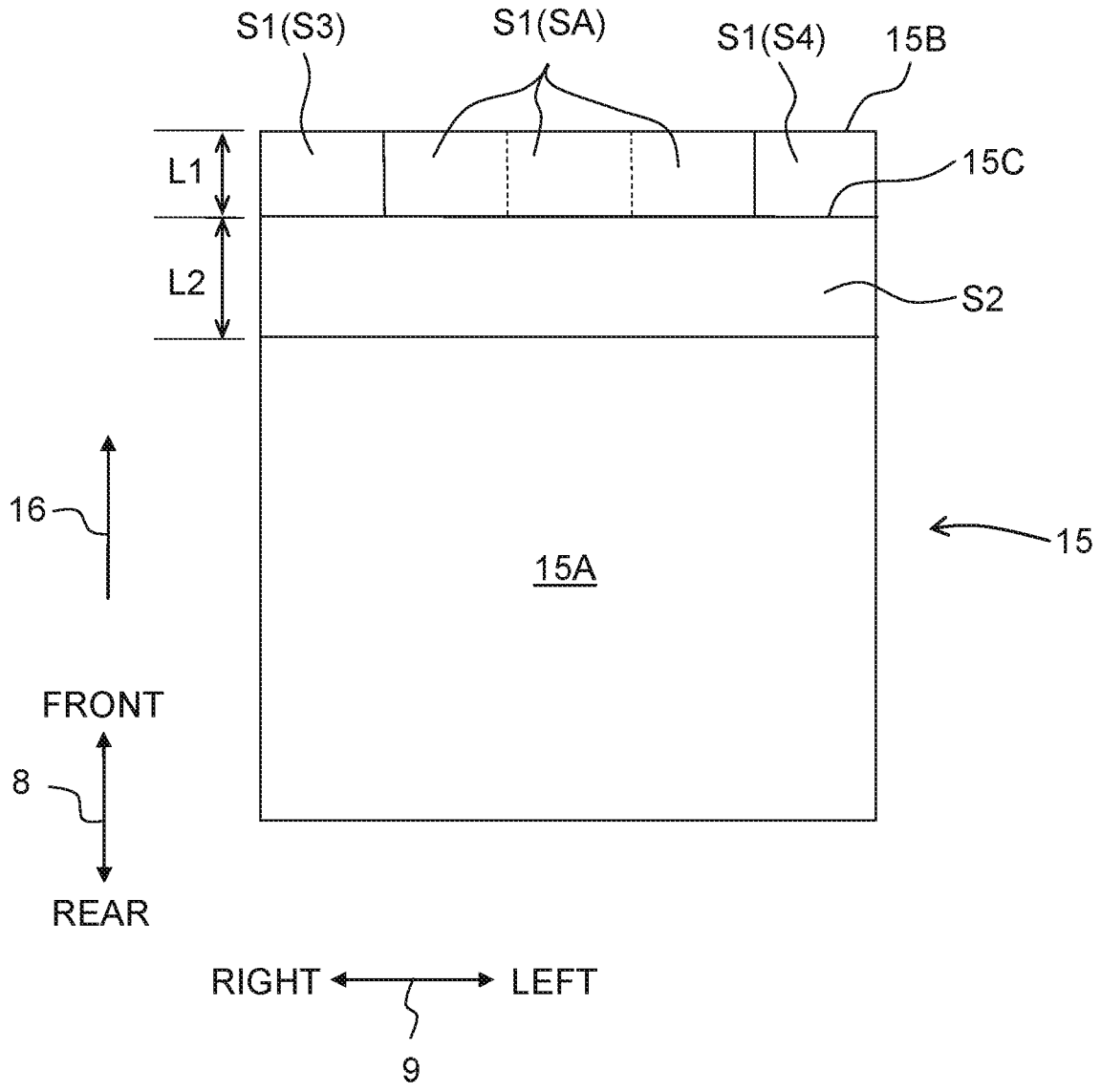
FIG. 4 schematically depicts a first area, a second area, a third area, and a fourth area that are formed as pseudo images on a printing surface of a sheet.

The first threshold value TH1 is a value to be compared to a first amount, which is an ink amount per unit area of the ink jetted from the nozzles 36 of the head 37 to the first area S1 of the printing surface of the sheet 15. As depicted in FIG. 4, the first area S1 is included in a printing surface 15A of the sheet 15 and is positioned at a downstream end in the conveyance direction 16. The first area S1 includes a downstream end 15B in the conveyance direction 16. In this embodiment, the first area S1 is included in the printing surface 15A of the sheet 15, extends in the left-right direction 9 from a left end to a right end of the sheet 15, and extends from the downstream end 15B in the conveyance direction 16 to have a length L1. Namely, the first area S1 is formed by an area SA, a third area S3, and a fourth area S4 depicted in FIG. 4. The length L1 may be any length. In this embodiment, the length L1 is set to a length that is an approximately one-eighth of the length in the front-rear direction 8 of the sheet 15.

The second threshold value TH2 is a value to be compared to a second amount, which is an ink amount per unit area of the ink jetted from the nozzles 36 of the head 37 to the second area S2 of the printing surface of the sheet 15. As depicted in FIG. 4, the second area S2 is an area that is included in the printing surface 15A of the sheet 15, positioned upstream of the first area S1 in the conveyance direction 16, and adjacent to the first area S1. In this embodiment, the second area S2 is included in the printing surface 15A of the sheet 15, extends in the left-right direction 9 from the left end to the right end of the sheet 15, and extends from an upstream end 15C in the conveyance direction 16 of the first area S1 to have a length L2. Namely, in this embodiment, a downstream end in the conveyance direction 16 of the second area S2 continues from the upstream end 15C in the conveyance direction 16 of the first area S1. The length L2 may be any length. In this embodiment, the length L2 is set to a length that is an approximately 1.4 times as long as the length L1.

The first area S1 and the second area S2 may not extend from the left end to the right end in the left-right direction 9 of the printing surface of the sheet 15, and they may partially extend in the left-right direction 9. In this embodiment, the length L1 is shorter than a length in the front-rear direction 8 of an area of the printing surface 15A of the sheet 15 where printing is performed by one pass. The length L1, however, may be equal to or longer than the length in the front-rear direction 8 of that area. In this embodiment, the length L2 is longer than the length in the front-rear direction 8 of the area of the printing surface 15A of the sheet 15 where printing is performed by one pass. The length L2, however, may be equal to or shorter than the length in the front-rear direction 8 of that area.

Figure 5:
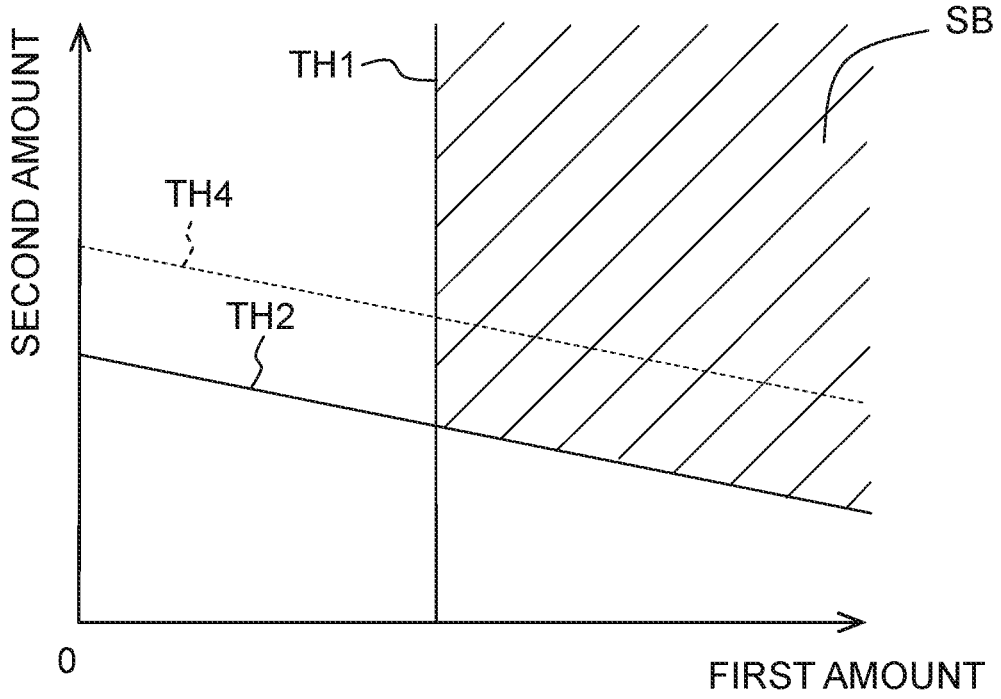
FIG. 5 is a graph indicating a first threshold value and a second threshold value with respect to a first amount and a second amount.

As depicted in FIG. 5, the controller 130 sets the second threshold value TH2 so that the second threshold value TH2 is smaller as the first amount is larger. For example, the second threshold value TH2 may be calculated by storing a function expression that corresponds to a straight line of the second threshold value TH2 depicted in FIG. 5 in the ROM 132 or the EEPROM 134 and substituting a value of the first amount for the function expression. Or, the second threshold value TH2 may be determined, for example, by storing a table data, which includes multiple values of the first amount and multiple second threshold values TH2 corresponding to the respective values of the first amount, in the ROM 132 or the EEPROM 134 and applying a certain value of the first amount to the table data.

The third threshold value TH3 is a value to be compared to a third amount, which is an ink amount per unit area of the ink jetted from the nozzles 36 of the head 37 to the third area S3 (see FIG. 4) of the printing surface 15A of the sheet 15, and a fourth amount which is an ink amount per unit area of the ink jetted from the nozzles 36 of the head 37 to the fourth area S4 (see FIG. 4) of the printing surface 15A of the sheet 15. As depicted in FIG. 4, the third area S3 and the fourth area S4 are parts of the first area S1. The third area S3 is an area included in the printing surface 15A of the sheet 15 and including a right end of the printing surface 15A of the sheet 15 (an exemplary first end in the width direction). The fourth area S4 is an area included in the printing surface 15A of the sheet 15 and including a left end of the printing surface 15A of the sheet 15 (an exemplary second end in the width direction).

As depicted in FIG. 4, in this embodiment, the third area S3 is a rightmost area among areas formed by dividing the first area S1 into five areas in the right left-right direction 9. The fourth area S4 is a leftmost area among the areas formed by dividing the first area S1 into the five areas in the right left-right direction 9. The length in the left-right direction 9 of each of the third area S3 and the fourth area S4 is not limited to that depicted in FIG. 4. For example, the third area S3 may be a rightmost area among areas formed by dividing the first area S1 into four areas in the left-right direction 9, and the fourth area S4 may be a leftmost area among the areas formed by dividing the first area S1 into the four areas in the left-right direction 9.

Similar to the second threshold value TH2, the fourth threshold value TH 4 is a value to be compared to the second amount. The fourth threshold value TH2 is set to a value larger than the second threshold value TH2. In this embodiment, the fourth threshold value TH4 is set to be parallel to the second threshold value TH2, as depicted by a broken line in FIG. 5. The fourth threshold value TH4 may be set not to be parallel to the second threshold value TH2, provided that the fourth threshold value TH4 is set so that the fourth threshold value TH4 has a smaller value as the first amount increases.

<Printing Control by Controller 130>

Figure 6A:
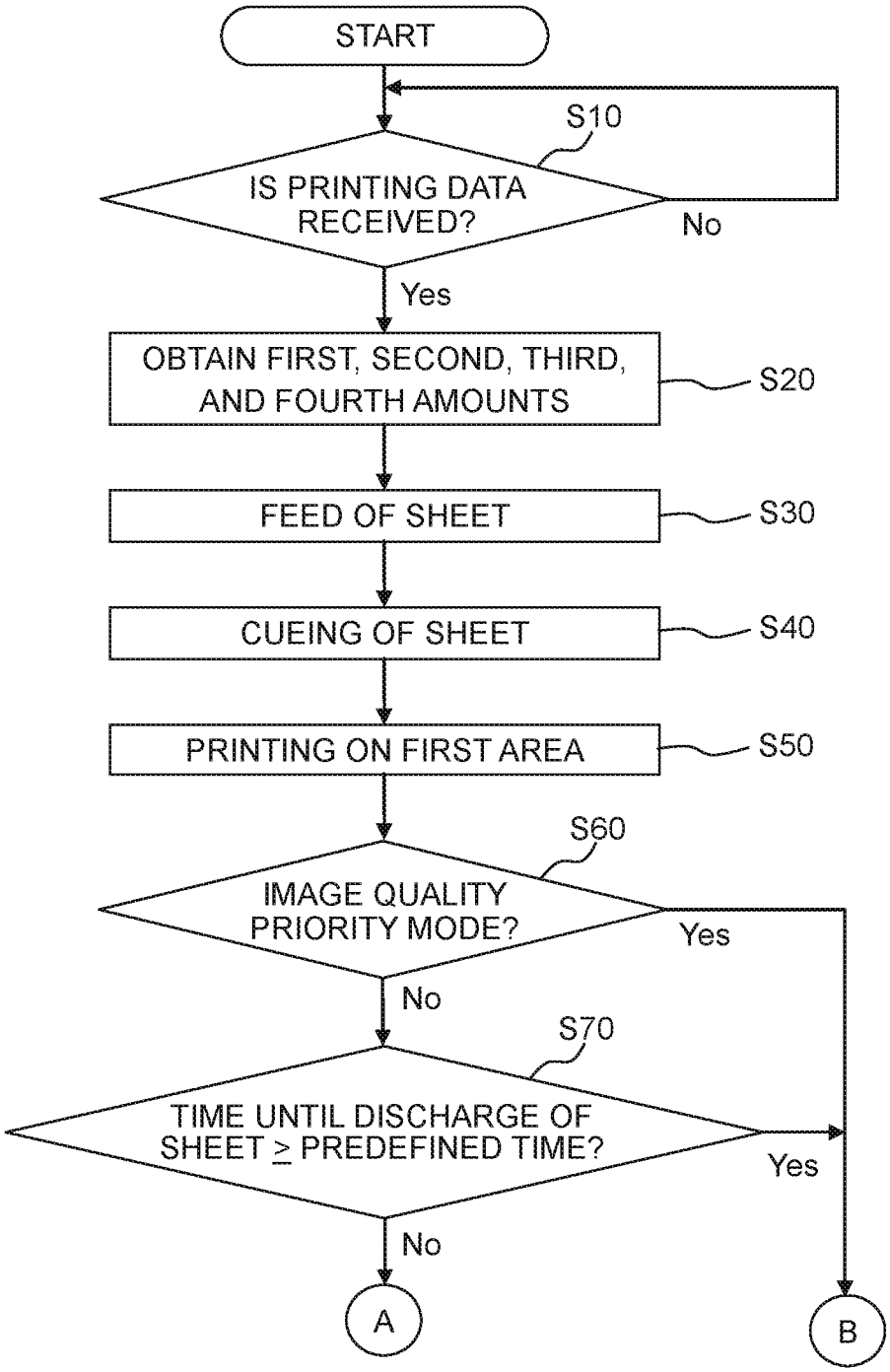
FIGS. 6A and 6B are a flowchart for illustrating print control processing.
Figure 6B:
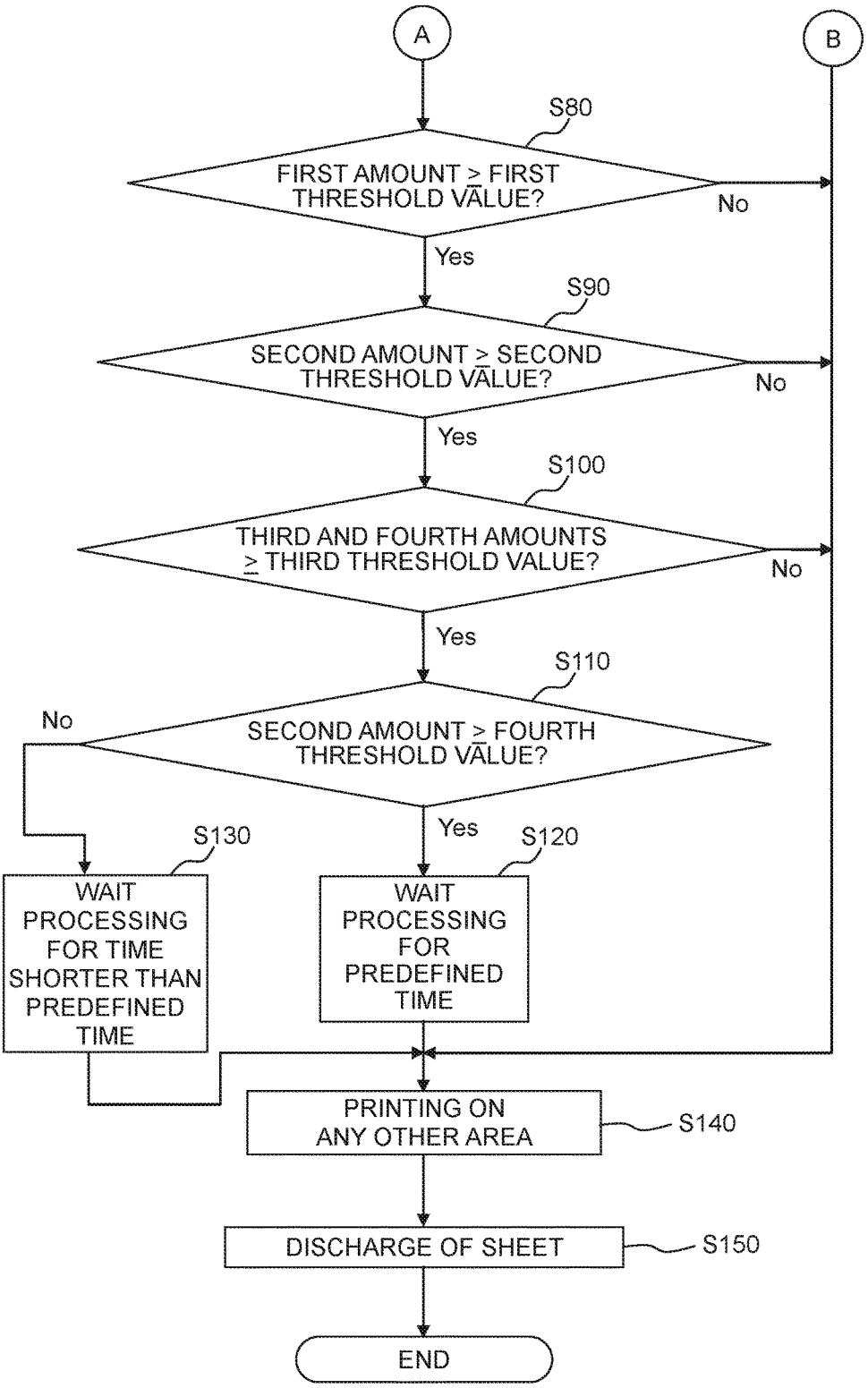

In the multifunction peripheral 10 configured as described above, the controller 130 executes a series of printing control in which the sheet 15 is fed and printing is performed on the sheet 15 fed. Referring to the flowchart of FIGS. 6A and 6B, processing of the printing control is explained below.

When the controller 130 receives printing data from the operation unit 17 (see FIG. 1) of the multifunction peripheral 10 or an external apparatus connected to the multifunction peripheral 10 (S10: Yes), the controller 130 obtains the first, second, third, and fourth amounts (S20).

Specifically, the controller 130 adds up ink amounts of dots to be formed in the first area S1 based on the printing data, and divides the total ink amount by a planar dimension of the first area S1, thus calculating the first amount (an ink amount per unit area in the first area S1). The controller 130 adds up ink amounts of dots to be formed in the second area S2 based on the printing data, and divides the total ink amount by a planar dimension of the second area S2, thus calculating the second amount (an ink amount per unit area in the second area S2). The controller 130 adds up ink amounts of dots to be formed in the third area S3 based on the printing data, and divides the total ink amount by a planar dimension of the third area S3, thus calculating the third amount (an ink amount per unit area in the third area S3). The controller 130 adds up ink amounts of dots to be formed in the fourth area S4 based on the printing data, and divides the total ink amount by a planar dimension of the fourth area S4, thus calculating the fourth amount (an ink amount per unit area in the fourth area S4).

Next, the controller 130 drives the feed motor 102 so that the feed roller 25 feeds the sheet 15 supported by the feed tray 20 to the conveyance path 23 (S30).

Subsequently, the controller 130 executes cueing of the sheet 15 (S40). The cueing of the sheet 15 is processing for conveying the sheet 15 to a printing start position facing the recording unit 24. Specifically, the controller 130 drives the conveyance motor 101 so that the conveyance roller pair 63 conveys the sheet 15 in the conveyance direction 16 until the sheet 15 reaches the printing start position. In the printing start position, a downstream end in the conveyance direction 16 of a printing area of the sheet 15 faces some nozzles 36 arranged at the most downstream side in the conveyance direction 16. The printing area is an area, of the printing surface of the sheet 15, except for blanks (edges of the sheet 15 on which no ink droplets are jetted). The areas S1, S2, S3, and S4 may include the blanks.

Next, the controller 130 executes printing on the sheet 15 by alternately repeating the print processing and the intermittent conveyance processing. The printing is performed on the printing surface 15A of the sheet 15 from a downstream area to an upstream area in the conveyance direction 16. Namely, printing on the first area S1 of the printing surface is performed first (S50), printing on the second area S2 of the printing surface is performed second (S140), and then printing on any other area of the printing surface is performed (S140).

When the printing on the first area S1 of the printing surface 15A of the sheet 15 is completed, the controller 130 refers to the printing data received in the step S10. The printing data includes any of a first command by which printing by use of a velocity priority mode is executed and a second command by which printing by use of an image quality priority mode is executed. In the velocity priority mode, printing velocity on the sheet 15 takes priority over a quality of an image to be printed on the sheet 15 (i.e., the time required for printing on the sheet 15 is shortened in the velocity priority mode). In the image quality priority mode, a quality of an image to be printed on the sheet 15 takes priority over printing velocity on the sheet 15.

When the printing data received in the step S10 includes the second command (S60: Yes), the controller 130 executes printing on an area that is included in the printing surface 15A of the sheet 15 and different from the first area S1 without executing WATT processing (S120, S130) described below (S140).

When the printing data received in the step S10 does not include the second command (S60: No), the controller 130 determines whether a time after printing on the first area S1 of the printing surface 15A of the sheet 15 is executed before the sheet 15 is discharged (more specifically, before the downstream end 15B in the conveyance direction 16 of the sheet 15 makes contact with the discharge tray 21) is equal to or longer than a predefined time (S70).

The predefined time is set in advance as a time required for drying the ink jetted on the first area S1 of the printing surface of the sheet 15. The predefined time is stored in the ROM 132, the EEPROM 134, or the like. The time after printing on the first area S1 of the printing surface 15A of the sheet 15 is executed before the sheet 15 is discharged can be determined based on the rotation velocity of the conveyance roller 61 and the discharge roller 64, the length in the conveyance direction 16 of the sheet 15, the moving velocity of the carriage 38, a non-operation time of the conveyance roller 61 and the discharge roller 64 during the intermittent conveyance processing, the distance in the conveyance direction 16 between the head 37 and the discharge tray 21, and/or the like.

When the time after printing on the first area S1 of the printing surface 15A of the sheet 15 is executed before the sheet 15 is discharged is equal to or longer than the predefined time (S70: Yes), the controller 130 executes printing on any other area than the first area S1 of the printing surface of the sheet 15 without executing the WAIT processing (S120, S130).

When the time after printing on the first area S1 of the printing surface 15A of the sheet 15 is executed before the sheet 15 is discharged is less than the predefined time (S70: No), the controller 130 determines whether the first amount obtained in the step S20 is equal to or more than the first threshold value TH1 (S80: Yes) and the second amount obtained in the step S20 is equal to or more than the second threshold value TH2 (S90: Yes).

When the first amount is less than the first threshold value TH1 (S80: No, an area on the left side of the first threshold value TH1 in FIG. 5) or the second amount is less than the second threshold value TH 2 (S90: No, an area on the lower side of the second threshold value TH2 in FIG. 5), the controller 130 executes printing on any other area than the first area S1 of the printing surface of the sheet 15 (S140) without executing the WATT processing (S120, S130).

When the first amount is equal to or more than the first threshold value TH1 (S80: Yes) and the second amount is equal to or more than the second threshold value TH2 (S90: Yes), namely, in a case of an area Sb hatched in FIG. 5, the controller 130 determines whether any of the third amount and the fourth amount is equal to or more than the third threshold value TH3 (S100).

When both of the third amount and the fourth amount are less than the third threshold value (S100: No), the controller 130 executes printing on any other area than the first area S1 of the printing surface of the sheet 15 (S140) without executing the WATT processing (S120, S130).

When any of the third amount and the fourth amount is equal to or more than the third threshold value TH3 (S100: Yes), the controller 130 determines whether the second amount is equal to or more than the fourth threshold value TH4 (S110).

When the second amount is equal to or more than the fourth threshold value TH4 (S110: No, an area on the upper side of the fourth threshold value TH4 in FIG. 5), the controller 130 executes the WAIT processing for a predefined time (S120). The WATT processing is processing for stopping operation of the discharge roller 64 for the predefined time. Executing the WATT processing for the predefined time delays discharge of the sheet 15 on the discharge tray 21 for the predefined time.

When the second amount is less than the fourth threshold value TH4 (S110: No, an area between the second threshold value TH2 and the fourth threshold value TH4 in FIG. 5), the controller 130 executes the WAIT processing for a time shorter than the predefined time (S130). This delays discharge of the sheet 15 on the discharge tray 21 for the time shorter than the predefined time.

After recovery from the state where the operation of the discharge roller 64 is stopped, the controller 130 executes printing on any other area than the first area S1 of the printing surface of the sheet 15 (S140). After the step S140, the controller 130 controls the discharge roller 64 to convey the sheet 15 in the conveyance direction 16 and to discharge the sheet 15 on the discharge tray 21 (S150).

<Effects of the Embodiment>

When the amount of ink jetted on the first area S1 is large, the first area S1 of the sheet 15 swells, which curves the sheet 15 easily. When the amount of ink jetted on the first area S1 is large and when the amount of ink jetted on the second area S2 is large, the rigidity of the second area S2 of the sheet 15 decreases, which curves the first area S1 of the sheet 15 already having the easy-to-curve state. When the amount of ink jetted on the first area S1 is large and when the amount of the ink jetted on the second area S2 is small, the rigidity of the second area S2 of the sheet 15 is less likely to decrease. This inhibits the curve of the first area S1 of the sheet 15. Namely, even when the amount of ink jetted on the first area S1 is large, the curve of the first area S1 of the sheet 15 is inhibited when the amount of ink jetted on the second area S2 is small.

In this embodiment, the controller 130 stops conveyance of the sheet 15 for the predefined time (S120, S130) when the first amount is equal to or more than the first threshold value TH1 (S80: Yes) and when the second amount is equal to or more than the second threshold value TH2 (S90: Yes). However, even when the first amount is equal to or more than the first threshold value TH1 (S80: Yes), the controller 130 does not stop conveyance of the sheet 15 when the second amount is less than the second threshold value TH2 (S90: No). This reduces the frequency of the processing in which conveyance of the sheet 15 is stopped.

The first area S1 of the sheet 15 is more likely to curve as the amount of ink jetted on the first area S1 increases. Namely, when the amount of ink jetted on the first area S1 is large, the first area S1 of the sheet 15 may curve even when the amount of ink jetted on the second area S2 is small.

In this embodiment, the second threshold value TH2 is set to be a smaller value as the first amount is larger. Thus, conveyance of the sheet 15 is more likely to be stopped as the first area S1 of the sheet 15 is more likely to curve. This inhibits the curve of the first area S1 of the sheet 15.

A center portion in the left-right direction 9 of the sheet 15 is less likely to curve than ends in the left-right direction 9 of the sheet 15. Namely, even when the amount of ink jetted on the center portion in the left-right direction 9 of the sheet 15 is large, the sheet 15 is not likely to curve when the amounts of ink jetted on the third area S3 and the fourth area S4, which are the ends in the left-right direction 9 of the sheet 15, are small. In this embodiment, when the third amount and the fourth amount are less than the third threshold value TH 3 (S100: No), the controller 130 does not stop conveyance of the sheet 15. This can discharge the sheet 15 as early as possible.

In this embodiment, since the second area S2 continues from the first area S1, the decrease in rigidity of the second area S2 of the sheet 15 easily affects the likelihood of curve of the first area S1 of the sheet 15. This can reduce the possibilities that conveyance of the sheet 15 is not stopped when the first area S1 of the sheet 15 is likely to curve and that the controller 130 erroneously stops conveyance of the sheet 15 when the first area S1 of the sheet 15 is not likely to curve.

When the second amount is less than the fourth threshold value (S110: No), the rigidity of the sheet 15 is less likely to decrease than the case in which the second amount is equal to or more than the fourth threshold value (S110: Yes). Namely, when the second amount is less than the fourth threshold value (S110: No), the first area S1 of the sheet 15 is less likely to curve than the case in which the second amount is equal to or more than the fourth threshold value (S110: Yes). In this embodiment, when the second amount is less than the fourth threshold value (S110: No), the predefined time is shortened (S130). This can discharge the sheet 15 as early as possible.

When printing on the sheet 15 is executed using the image quality priority mode, the time after ink is jetted on the first area S1 of the sheet 15 before the sheet is discharged is long. This can dry the ink adhering to the sheet 15. In this embodiment, when printing on the sheet 15 is executed using the image quality priority mode (S60: Yes), the controller 130 does not stop conveyance of the sheet 15. This can discharge the sheet 15 as early as possible.

When the time after ink is jetted on the first area S1 of the sheet 15 before the sheet 15 makes contact with the discharge tray 21 is equal to or longer than the predefined time (S70: Yes), the ink adhering to the sheet 15 is considered to be already dried. In that case (S70: Yes), the controller 130 does not stop conveyance of the sheet 15 in this embodiment. This can discharge the sheet 15 as early as possible.

<Modified Examples>

In the above embodiment, when predefined conditions are satisfied (S60: No, S70: No, S80: Yes, S90: Yes, and S100: Yes), the controller 130 executes the WATT processing. The controller 130, however, may execute processing different from the WATT processing when the predefined conditions are satisfied. Namely, the controller 130 may lower a level of the drive signal to be output to the drive circuit corresponding to the conveyance motor 101. This may make the rotation velocity of at least one of the conveyance roller 61 and the discharge roller 64 slow, thus conveying the sheet 15 at a second velocity slower than a first velocity. The first velocity is a normal conveyance velocity of the sheet 15. Namely, in the above embodiment, the sheet 15 is conveyed at the first velocity before and after the WAITING processing. In this modified example, the controller 130 conveys the sheet 15 at a predefined velocity slower than the first velocity in the step S120, and conveys the sheet 15 at a velocity faster than the predefined velocity and slower than the first velocity in the step S130.

In the above embodiment, when the time after printing on the first area S1 of the printing surface 15A of the sheet 15 is executed before the sheet 15 is discharged is less than the predefined time, the controller 130 executes the WAIT processing for a certain amount of time (the predefined time in the step S130, a time shorter than the predefined time in the step S120). The controller 130, however, may shorten the time for executing the WATT processing by an amount corresponding to the time after printing on the first area S1 of the printing surface 15A of the sheet 15 is executed before the sheet 15 is discharged. In that case, the time for executing the WAIT processing in each of the steps S120 and S130 is even shorter than the certain amount of time.

The ink adhering to the first area S1 is dried during the time after ink is jetted on the first area S1 of the printing surface 15A of the sheet 15 before the sheet 15 makes contact with the discharge tray 21. In the modified example, the predefined time is shortened by the amount corresponding to the certain amount of time. This can discharge the sheet 15 as early as possible.

The controller 130 may set the second threshold value TH2 for the case in which the sheet 15 is discharged on the discharge tray 21 while the discharger roller 64 alternately executes conveyance of the sheet 15 and a standstill or stop of conveyance of the sheet 15, to a value larger than that for the case in which the sheet 15 is discharged on the discharge tray 21 while the discharge roller 64 continuously conveys the sheet 15.

The situation in which the sheet 15 is discharged on the discharge tray 21 while the discharger roller 64 alternately executes the conveyance of the sheet 15 and the standstill of conveyance of the sheet 15 is as follows. When the controller 130 executes printing based on printing data to be printed on multiple sheets 15, the discharge roller 64 conveys a preceding sheet 15 toward the discharge tray 21 in the conveyance direction 16 while the conveyance roller 61 coveys a succeeding sheet 15 in the conveyance direction 16 to perform printing on the succeeding sheet 15. In that case, the conveyance roller 61 conveys the succeeding sheet 15 intermittently. Since the conveyance roller 61 and the discharge roller 64 are driven by the common conveyance motor 101, the discharge roller 64 conveys the preceding sheet 15 intermittently.

The situation in which the sheet 15 is discharged on the discharge tray 21 while the discharge roller 64 continuously conveys the sheet 15 is as follows. This situation may occur, for example, when the controller 130 executes printing based on printing data to be printed on one sheet and when the last sheet 15 is discharged on the discharge tray 21 by use of the discharge roller 64 in the printing based on printing data to be printed on multiple sheets 15. In the above cases, there is no succeeding sheet 15 conveyed intermittently, and thus the discharger roller 64 conveys no sheet 15 intermittently.

When the sheet 15 is discharged on the discharge tray 21 while the discharge roller 64 alternately executes the conveyance of the sheet 15 and the standstill or stop of conveyance of the sheet 15, ink adhering to the sheet 15 is dried during the time in which conveyance of the sheet 15 is stopped. In the above modified example, the second threshold value TH2 is set to have a large value, which reduces the decrease in conveyance velocity of the sheet 15 and the frequency of standstill of conveyance of the sheet 15. The sheet 15 can thus be discharged as early as possible.

Printing data may include information specifying the kind of the sheet 15 on which ink is to be jetted using the head 37. The kind of the sheet 15 may be a regular sheet or a glossy sheet. When printing data includes such information, the controller 130 may vary the second threshold value TH2 based on the information. For example, the glossy sheet is less likely to curve than the regular sheet. Thus, when printing data includes information in which the kind of the sheet 15 is the glossy sheet, the second threshold value TH2 may be larger than that used when printing data includes information in which the kind of the sheet 15 is the regular sheet. Namely, when printing data includes the information in which the kind of the sheet 15 is the glossy sheet, the WATT processing may be less likely to be executed.

The sheet 15 may be a sheet that is likely to curve or a sheet that is not likely to curve. In the above modified example, the second threshold value TH2 depends on the kind of the sheet 15. When ink is jetted on the sheet 15 that is likely to curve (e.g., the regular sheet), the second threshold value TH2 may be set to be a small value. This easily causes the decrease in conveyance velocity of the sheet 15 and the standstill of conveyance of the sheet 15, making it possible to inhibit the curve of the sheet 15. When ink is jetted on the sheet 15 that is not likely to curve (e.g., the glossy sheet), the second threshold value TH2 may be set to a large value. This inhibits the unnecessary decrease in conveyance velocity of the sheet 15 and the unnecessary standstill of conveyance of the sheet 15.

In the above embodiment, the predefined time in which the WAIT processing is executed has two lengths of time. Namely, a long predefined time is used in the step S120, and a short predefined time is used in the step S130. However, the predefined time in which the WAIT processing is executed may have three or more lengths of time. For example, when the predefined time in which the WAIT processing is executed has three lengths of time, a fifth threshold value TH5, which is larger than the fourth threshold value TH4, is further set. When the second amount is equal to or more than the second threshold value TH2 and less than the fourth threshold value TH4, the predefined time is set to have the shortest length. When the second amount is equal to or more than the fifth threshold value TH5, the predefined time is set to have the longest length. When the second amount is equal to or more than the fourth threshold value TH4 and less than the fifth threshold value TH5, the predefined time is set to have a length between the two predefined times.

In the above embodiment, when the third amount and the fourth amount are less than the third threshold value TH3 (S100: No), the controller 130 does not execute the WAIT processing (S120, S130). The controller 130, however, may not execute the WAIT processing (S120, S130) when any of the third amount and the fourth amount is less than the third threshold value TH3 (S100: No).

In the above embodiment, the second area S2 is included in the printing surface 15A of the sheet 15, positioned upstream of the first area S1 in the conveyance direction 16, and adjacent to the first area S1. However, the second area S2 may be separated from the first area S1 in the conveyance direction 16 as depicted in FIG. 7A. Or, the second area S2 may overlap with the first area S1 in the conveyance direction 16 as depicted in FIG. 7B.

Figure 7B:
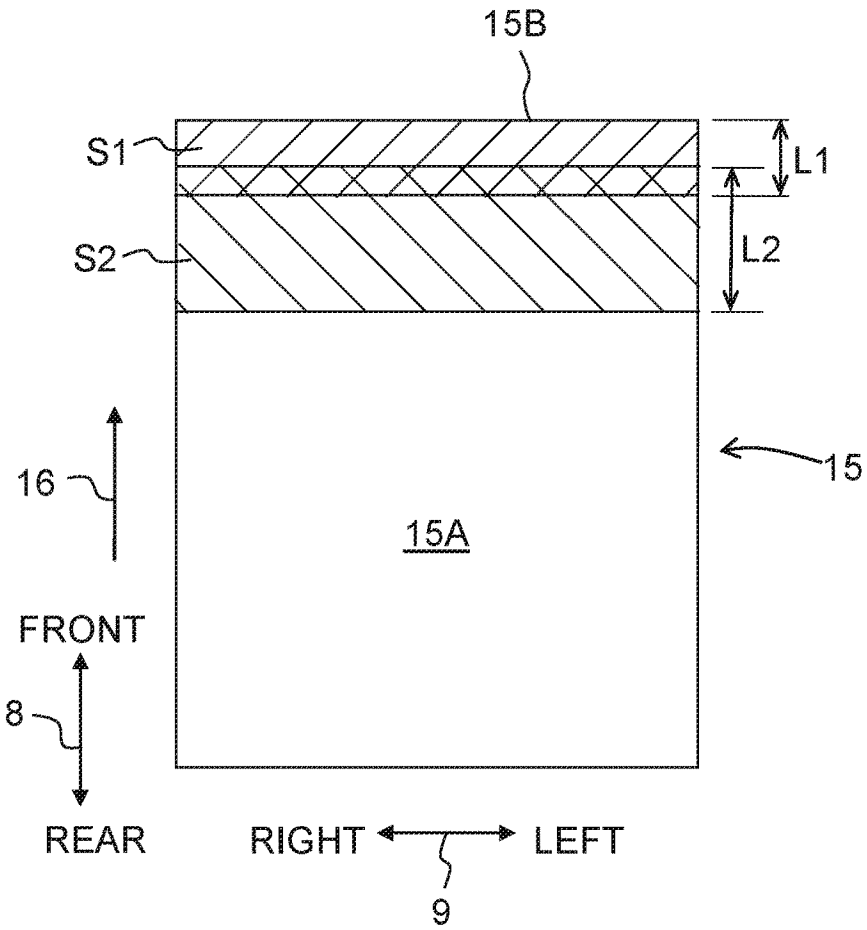
FIGS. 7A and 7B each schematically depict the first area and the second area that are formed as pseudo images on the printing surface of the sheet according to a modified example.
Figure 7A:
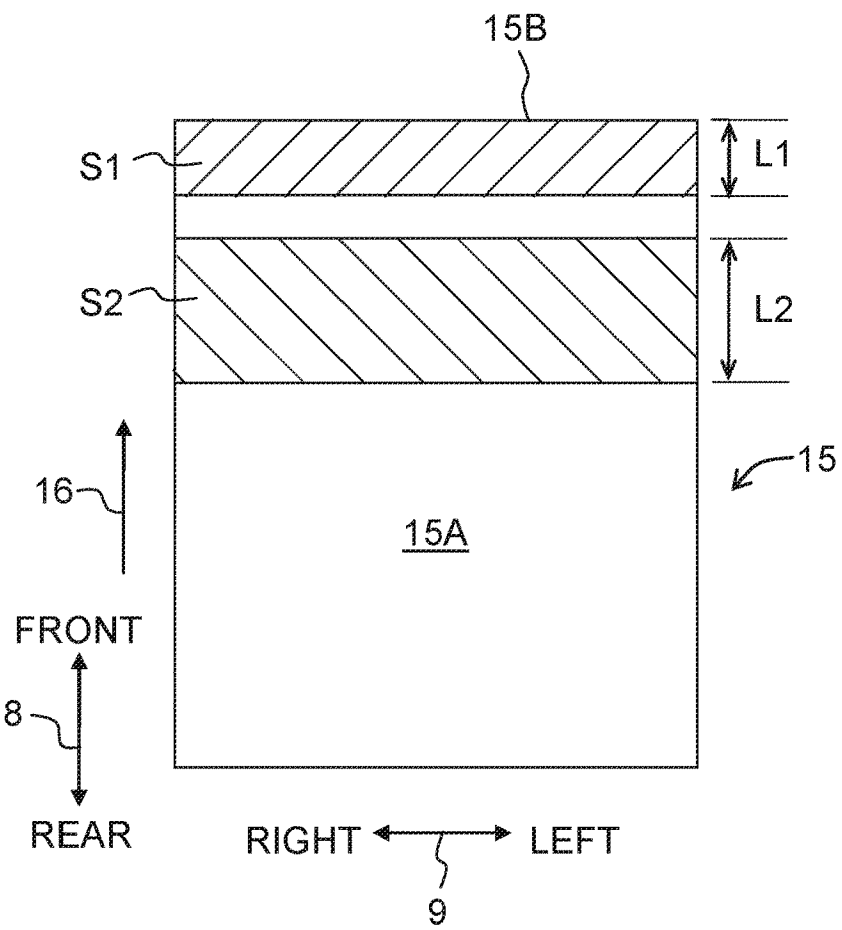

In the configuration depicted in FIG. 7B, the second area S2 overlaps with the first area S1. Thus, the decrease in rigidity of the second area S2 of the sheet 15 easily affects the likelihood of curve of the first area S1 of the sheet 15. This can reduce the possibilities that the conveyance velocity of the sheet 15 is not decreased or conveyance of the sheet 15 is not stopped with the first area S1 of the sheet 15 curved, and that the controller 130 erroneously decreases the conveyance velocity of the sheet 15 or erroneously stops conveyance of the sheet 15 with the first area S1 of the sheet 15 not curved.

Figure 8:
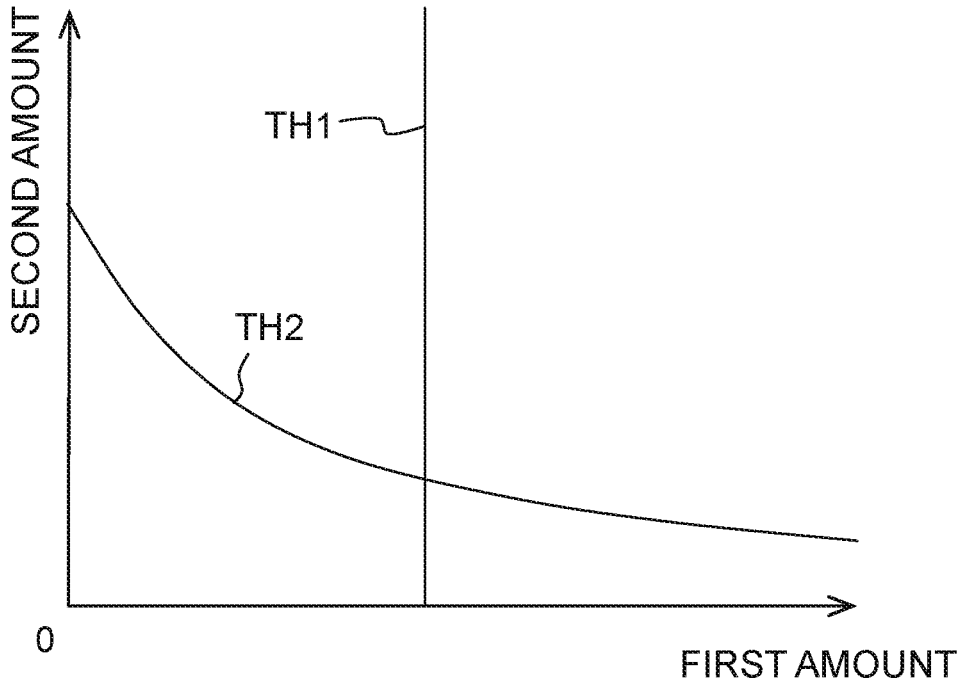
FIG. 8 is a graph indicating the first threshold value and the second threshold value with respect to the first amount and the second amount according to the modified example.

In the above embodiment, the second threshold value TH2 decreases linearly as the first amount increases (see FIG. 5). The correlation between the second threshold value TH2 and the first amount is not limited to that depicted in FIG. 5. For example, the correlation may be that depicted in FIG. 8. Namely, the second threshold value TH2 may not decrease linearly provided that it decreases as the first amount increases.

In the above embodiment, the multifunction peripheral 10 performs printing on the sheet 15 in accordance with a serial head system in which the head 37 carried on the carriage 38 moves in the left-right direction 9. The multifunction peripheral 10, however, may perform printing on the sheet 15 in accordance with a line head system in which a fixed head that is long in the left-right direction 9 is used.

In the above embodiment, ink is an exemplary liquid. The present teaching, however, is not limited thereto. For example, a pretreatment liquid, which is jetted on a sheet before ink is jetted on the sheet during printing, may be an exemplary liquid.

What is claimed is:

1. A liquid jetting apparatus, comprising:

a conveyance roller;

a head positioned downstream of the conveyance roller in a conveyance direction;

a discharge roller positioned downstream of the head in the conveyance direction;

a tray positioned downstream of the discharge roller in the conveyance direction and configured to support a sheet on which an image has been recorded using the head;

a memory; and a controller configured to:

receive printing data, drive the conveyance roller and the discharge roller to convey a sheet at a first velocity in the conveyance direction, and control the head to jet liquid on a printing surface of the sheet conveyed by the conveyance roller and the discharge roller, wherein the controller is configured to:

obtain a first amount and a second amount based on the printing data, the first amount being a jetting amount per unit area of the liquid jetted from the head on a first area that is included in the printing surface and includes a downstream end of the printing surface in the conveyance direction, the second amount being a jetting amount per unit area of the liquid jetted from the head on a second area that is included in the printing surface and positioned upstream of the first area in the conveyance direction; and in a case that the first amount is equal to or more than a first threshold value stored in the memory and the second amount is equal to or more than a second threshold value stored in the memory, after jetting the liquid from the head on the first area, drive the conveyance roller and the discharge roller to execute conveyance of the sheet at a second velocity slower than the first velocity and to discharge the sheet on the tray, or stop the conveyance roller and the discharge roller to stop the conveyance of the sheet for a predefined time, and then drive the conveyance roller and the discharge roller to execute the conveyance of the sheet at the first velocity and to discharge the sheet on the tray.

2. The liquid jetting apparatus according to claim 1, wherein the controller is configured to set the second threshold value to a smaller value as the first amount is larger.

3. The liquid jetting apparatus according to claim 1, wherein the first area includes a third area that is included in the printing surface and includes a first end in a width direction, which is orthogonal to the conveyance direction and along the printing surface, and a fourth area that is included in the printing surface and includes a second end in the width direction, in a case that at least one of a third amount or a fourth amount is less than a third threshold value stored in the memory based on the printing data, the controller is configured not to execute the conveyance of the sheet at the second velocity and not to stop the conveyance of the sheet for the predefined time, the third amount being a jetting amount per unit area of the liquid jetted from the head on the third area, the fourth amount being a jetting amount per unit area of the liquid jetted from the head on the fourth area.

4. The liquid jetting apparatus according to claim 1, wherein a downstream end in the conveyance direction of the second area continues from an upstream end in the conveyance direction of the first area.

5. The liquid jetting apparatus according to claim 1, wherein the first area partially overlaps with the second area in the conveyance direction.

6. The liquid jetting apparatus according to claim 1, wherein the controller is configured to increase the second velocity or shorten the predefined time, in a case that the second amount is equal to or more than the second threshold value and less than a fourth threshold value that is stored in the memory and is greater than the second threshold value.

7. The liquid jetting apparatus according to claim 1, wherein the printing data includes information that specifies a kind of the sheet for which the liquid is to be jetted using the head, and the controller is configured to vary the second threshold value based on the information.

8. The liquid jetting apparatus according to claim 1, wherein the controller is configured to: stop the conveyance of the sheet by use of the conveyance roller and the discharge roller; jet the liquid from the head on the printing surface of the sheet of which conveyance is stopped; and set the second threshold value used in a case that the conveyance roller and the discharge roller convey the sheet intermittently to a value greater than a value used in a case that the conveyance roller and the discharge roller convey the sheet continuously, the intermittent conveyance being conveyance in which the sheet is discharged on the tray while the conveyance roller and the discharge roller alternately execute the conveyance of the sheet and the stop of the conveyance of the sheet, the continuous conveyance being conveyance in which the conveyance roller and the discharge roller discharge the sheet on the tray continuously.

9. The liquid jetting apparatus according to claim 1, wherein the liquid is ink, the printing data includes a first command or a second command, the first command being a command by which printing using a velocity priority mode is executed, the second command being a command by which printing using an image quality priority mode is executed, the velocity priority mode being a mode in which velocity of printing on the sheet takes priority over a quality of an image printed on the sheet, the image quality priority mode being a mode in which the quality of the image printed on the sheet takes priority over the velocity of the printing on the sheet, and in a case that the printing data includes the second command, the controller is configured not to execute the conveyance of the sheet at the second velocity and not to stop the conveyance of the sheet for the predefined time.

10. The liquid jetting apparatus according to claim 1, wherein in the case that the first amount is equal to or more than the first threshold value and the second amount is equal to or more than the second threshold value, after jetting the liquid from the head on the first area, the controller is configured to: stop the conveyance of the sheet for the predefined time; execute the conveyance of the sheet at the first velocity, and discharge the sheet on the tray, and the controller is configured to shorten the predefined time depending on a time after the liquid is jetted on the first area of the sheet before the sheet makes contact with the tray.

11. The liquid jetting apparatus according to claim 1, wherein in the case that the first amount is equal to or more than the first threshold value and the second amount is equal to or more than the second threshold value, after jetting the liquid from the head on the first area, the controller is configured to: stop the conveyance of the sheet for the predefined time; execute the conveyance of the sheet at the first velocity, and discharge the sheet on the tray, and in a case that a time after the liquid is jetted on the first area of the sheet before the sheet makes contact with the tray is equal to or more than the predefined time, the controller is configured not to stop the conveyance of the sheet for the predefined time.

* * * * *